US006128870A

United States Patent [19]

Kohler

[11] Patent Number: 6,128,870

[45] Date of Patent: Oct. 10, 2000

[54] ROOF VENT SYSTEM

[76] Inventor: Raymond L. Kohler, 2509 E. Fairview Cir., Mesa, Ariz. 85204

[21] Appl. No.: 09/317,452

[22] Filed: May 24, 1999

[51] Int. Cl.[7] ..... F24F 7/02; E04B 7/18; E04D 13/17

[52] U.S. Cl. ..... 52/199; 52/57; 52/302.3; 52/302.6; 454/365

[58] Field of Search ..... 52/198, 199, 57, 52/302.3, 302.6; 454/365, 367

[56] References Cited

U.S. PATENT DOCUMENTS

| | | | |
|---|---|---|---|
| 2,214,183 | 9/1940 | Seymour | 52/199 X |
| 3,241,474 | 3/1966 | Rousey et al. | 454/365 |
| 3,326,113 | 6/1967 | Smith et al. | 454/365 |
| 3,481,263 | 12/1969 | Belden | 454/365 |
| 3,949,657 | 4/1976 | Sells | 52/199 X |
| 4,325,290 | 4/1982 | Wolfert | 454/365 |
| 4,545,291 | 10/1985 | Kutsch et al. | 454/365 |
| 4,558,637 | 12/1985 | Mason | 52/199 X |
| 4,573,291 | 3/1986 | Hofmann | 52/43 |
| 5,326,318 | 7/1994 | Rotter | 52/199 X |
| 5,339,582 | 8/1994 | Sells | 52/198 |
| 5,697,842 | 12/1997 | Donnelly | 52/199 X |
| 5,947,817 | 9/1999 | Morris et al. | 52/199 X |

FOREIGN PATENT DOCUMENTS

| | | | |
|---|---|---|---|
| 521165 | 1/1956 | Canada | 454/365 |
| 2399515 | 3/1979 | France | 454/365 |
| 4-153452 | 5/1992 | Japan | 52/302.3 |

*Primary Examiner*—Laura Callo
*Attorney, Agent, or Firm*—Gregory J. Nelson

[57] ABSTRACT

A roof vent system having side walls which are secured in spaced-apart relationship by flashing sections to the roof ridge. Spacers are provided at spaced-apart locations. The spacers may be extruded square tubular sections, Z-sections or other configurations. A screen extends between the side walls. A roof cap has a web which is held in place between the fasteners. The roof cap has flanges at its upper end which support a roof member such as a tile in an elevated position above the ridge to provide sufficient venting.

10 Claims, 2 Drawing Sheets

ROOF VENT SYSTEM

FIELD OF THE INVENTION

The present invention relates to a roof vent system and more particularly to a type of vent system in which it is mounted over the opening at the peak of the roof at the ridge line to allow air to vent or escape from the attic or crawl space.

BACKGROUND OF THE INVENTION

Many kinds of roof ventilators are found in the prior art. Some of these are turbine types which are wind driven. Evacuation of crawl space or attic space air is also accomplished by fans typically mounted at opposite ends of the attic which, in some cases are thermostatically controlled.

Other types of roof ventilators are of the type which are constructed to be mounted over the elongated opening along the ridge of the building roof. In most cases, these comprise some type of sheet metal structure having vents or perforations which the sheet metal structure is secured along the ridge. Representative of these type of devices is U.S. Pat. No. 4,545,291 which shows a ventilator comprised of sheet metal having an inner baffle and flu portions and an outer storm band casing. Louvers are provided in the base and baffle portions of the side wall.

U.S. Pat. No. 3,949,657 shows a ventilated cap which is placed over the opening in the ridge of the roof and includes a pair of beveled edge vent parts. Each vent part has transversely oriented openings extending from one beveled edge to the other. The vent parts are placed side-edge-to-side-edge over the opening in the roof ridge and secured to the underlying roof sides.

The early patent to Seymour, U.S. Pat. No. 2,214,183 shows a roofing and ventilated roof structure which discloses roofing units which may be used either at the overhang of an eave or gable or may be employed as an edging course associated with the ridge.

U.S. Pat. No. 4,558,637 discloses a ventilating member having a central, inverted V-shaped portion connecting the sides. Louvers and shield portions are located adjacent to the side louvers to prevent precipitation from passing through the support member and down into the ridge roof at openings.

U.S. Pat. No. 4,573,291 discloses a ridge covering having flexible ceiling strips arranged between the covering caps fastened to the ridge or hip board and the roofing tiles.

U.S. Pat. No. 4,325,290 shows a ridge ventilator for the roof of a building which includes a porous, non-woven and fibrous filter medium selectively installed in the ventilator to prevent inadvertent infiltration of moisture through the ventilator into the space below the roof.

Other representative ventilators constructed of sheet metal and fabricated having louvers or vents are shown in U.S. Pat. Nos. 3,481,263; and 3,241,474.

One roof vent system which has been commercially utilized is that shown in U.S. Pat. No. 5,339,582 sold under the designation COR-A-VENT. This patent shows an air dam mounted on a vent having openings extending transversely and placed upon the ridge of the roof. The air dam includes an outer and upper flange and a lower leg with the outer edge of the flange being spaced from the inner surface of a covering over the roof ridge to insure proper air flow from the roof peak and to form a barrier against the ingressive wind-driven moisture downwardly into the vent openings.

While the above prior art is representative of various roof vent designs and many of these systems have been placed into commercial use, there nevertheless exists a need for an improved roof vent which will be effective to provide the necessary free vent area required by various codes and which vent system is also easy to install and relatively inexpensive to manufacture.

BRIEF SUMMARY OF THE INVENTION

Briefly, the present invention provides a roof vent system which is prefabricated and may be provided to the roofing installer in sections and secured at the roof ridge. The system has a pair of spaced-apart side walls which at their lower end have angularly extending flashing sections which secure the system to the roof. The flashing is secured by fasteners to the sheeting on the rafters. Spacers are provided at spaced-apart locations between the vertical side walls. The spacers may be in the form of tubular sections, Z-sections or other mechanical components to maintain the side walls in spaced-apart positions and provide structural rigidity to the assembly. A screen extends between the side walls to prevent insects from entering into the subjacent attic or crawl space area.

The roof vent assembly of the present invention is used primarily with roofing systems in which generally semi-circular or S-tiles are placed in an alternating peak and valley arrangement on the roof sheeting. An arcuate roof cap extends along the roof line generally perpendicular to the tiles and is maintained at a predetermined elevation by a T-shaped support. The general T-shaped support has a central downwardly extending web section which is vertically secured to the spacers by fasteners extending through the side wall spacers and into the support. Upper flanges extend from the web and support the tile cap at an elevation selected to provide the necessary net free air space. The system may also be used with metal roofing.

BRIEF DESCRIPTION OF THE DRAWINGS

The above and other objects and advantages of the present invention will become more apparent from the following description, claims and drawings in which:

DETAILED DESCRIPTION OF THE DRAWINGS

Figure 2:
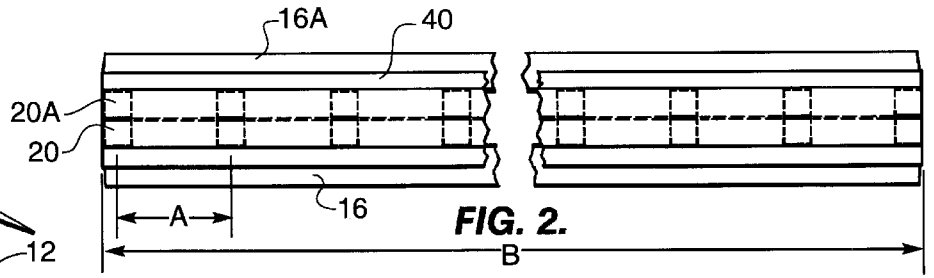
FIG. 2 is a top view of a section of the vent assembly according to the present invention with the distance between the spaced-apart spacers indicated by the letter "A"

Turning now to the drawings, particularly FIGS. 1 through 4, the roof vent assembly of the present invention is generally shown and is designated by the numeral 10. The roof vent assembly includes a pair of spaced-apart side walls 12 and 14. Each of the side walls has a vertical section 15 and 15A and an angular flashing section 16 and 16A. The sides may be fabricated from any suitable material such as a galvanized sheet metal formed in a suitable bending or stamping operation. The upper edges of the walls 15, 15A may be bent to form a lip 17 for increased strength and to eliminate an exposed sharp edge at the upper edge of the walls. The walls 12 and 14 are maintained in spaced-apart position by spacers 20, 20A which are positioned in side-by-side relationship at spaced-apart locations A as indicated in FIG. 2.

The spacers 20, 20A are preferably tubular sections and are shown as having a square cross-section. The spacers may be metal but it is preferred for economy of manufacture that they are extruded sections of a suitable weather and UV resistant plastic cut to an overall length less than the height of the wall 15. The spacing A between adjacent spacers will depend somewhat on various building codes but typically the spacers will be located on about 12" centers.

Figure 3:
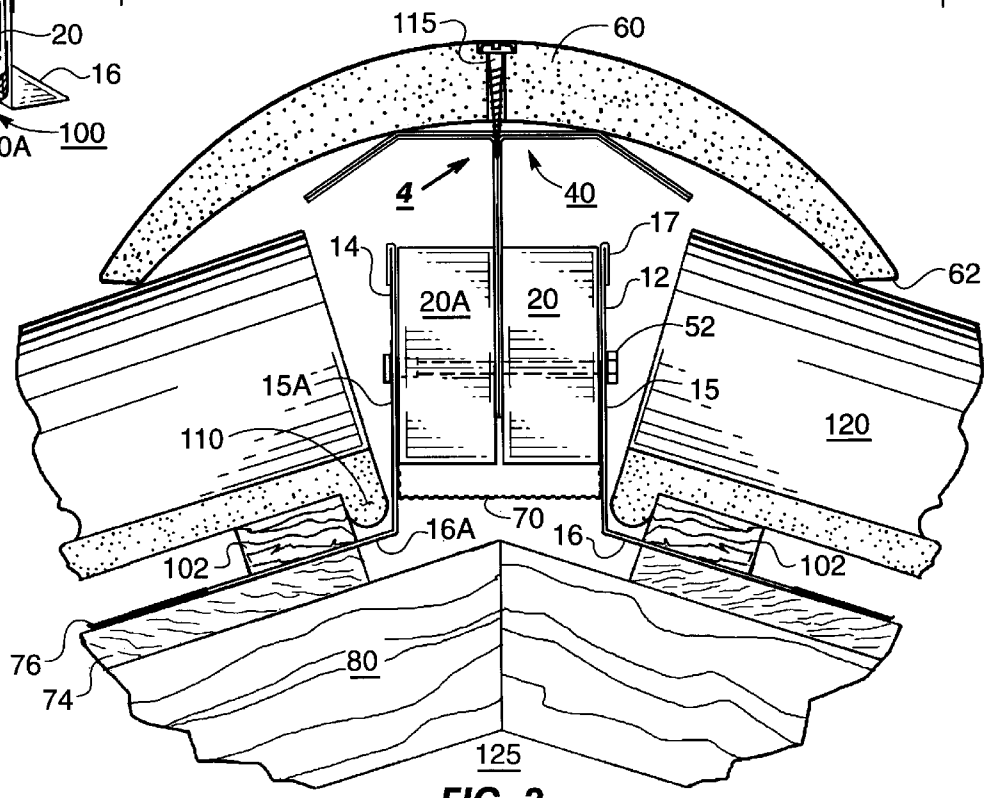
FIG. 3 is an end view of a roof ridge showing the vent assembly in an installed position.
Figure 4:
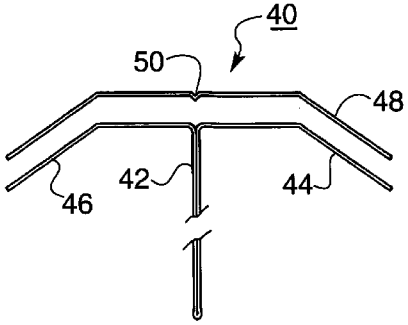
FIG. 4 is a detail view of the construction of the T-shaped cap support which is a part of the assembly designated by the figure reference numeral 4 in FIG. 3.

A cap support 40, which is shown in detail in FIG. 4, has a general T-configuration which includes a web 42 and opposite flange sections 44 and 46 at the upper end of the web. Sections 44, 46 and 42 can be fabricated from a single piece of material such as sheet metal and formed by bending into the shape shown in FIG. 4 with web 42 being a double wall or the cap support may be fabricated from separate pieces joined together. An additional hat section 48 formed from a single piece of metal may be applied over sections 44 and 46 for increased strength. Hat section 48 may be spot welded, clinch locked or otherwise secured to sections 44 and 46. It will be noted that there is a small trough or indentation 50 that extends along the upper surface of section 48. The support 40 is secured to the roof assembly by inserting web 42 between adjacent spacers 20 and 20A as seen in FIG. 3. The web of section 40 is inserted to an engagement depth as required by the particular roofing installation so as to position the cap 60 at a predetermined elevation above the roof to achieve the required venting area. Once the proper positioning of the support 40 has been determined, fasteners 52, shown as a bolt and nut or screws, may be driven through the side walls 15 penetrating through the spacers 20 and 20A and into the web 42.

The completed roof vent assembly 10 is then provided to the roofing contractor in sections having a length "B". The length B may be any suitable length but typically the vent assembly would be provided in sections of approximately 10 feet in length. A screen 70 will also be installed extending between the interior surfaces of the walls 15 below the spacers. The screen serves primarily to keep insects from the attic space. It will be seen that the completed assembly provides adequate ventilation space with little restriction to air flow, as the screen and spacers provide minimal obstruction.

Figure 1:
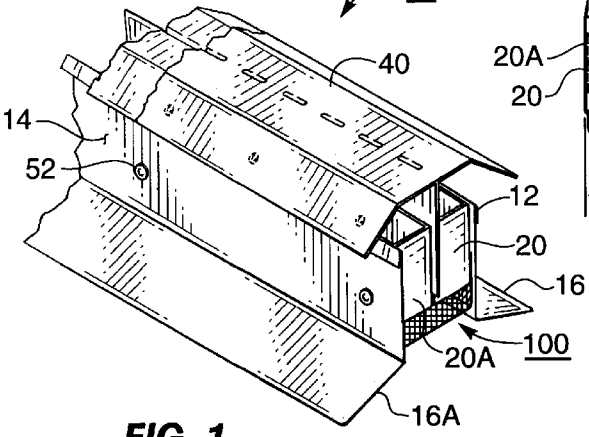
FIG. 1 is a perspective view of a section of the vent assembly according to the present invention.

The assembly is installed in the roof by placing the flashing sections 16 and 16A on the plywood deck 74 and roofing paper 76 covering the roof rafters 80 extending along the ridge of the roof. Abutting sections 10 can be aligned to achieve the required length. Preferably, the end-most spacers as seen in FIG. 1 are recessed at distance 100 (typically 6") from the vertical ends of the side walls 15, 15A. In this way, adjacent vent assembly sections 10 can be overlapped to provide the necessary sealing against entrance of moisture. Once the roof vent assemblies have been placed in position, the battens 102 are placed across the deck at spaced-apart intervals. Tile 120 is applied over the battens and may include a depending flange section 112 which overlaps the edge of the upper-most batten. Tiles 120 are then placed in conventional fashion over the roofing deck 74. The tiles 120 are placed in alternate peak and valley "S" orientation so that air flow is accommodated from the space 125 upwardly between the rafters through the vent assembly and outwardly beneath the cap 60. The air space beneath the edge 62 of the cap at its opposite extremities and the surface of the tiles 120 is defined as the net-free airspace. As indicated, the support 40 will be positioned to provide the necessary net-free airspace. The cap is secured by a fastener such as a screw or nail 115 extending through the cap into the support 40. The trough or indentation 50 in support 40 facilitates the alignment and penetration of the screw into the support. The sheet metal screw will penetrate upper section 48 of the support and will be received between the adjacent sheets that comprise the vertical web 42.

Figure 7:
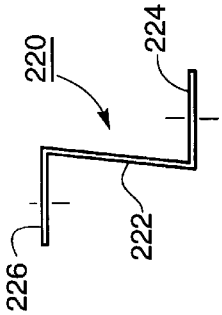
FIG. 7 is a detail view of a Z-shaped spacer used as part of the embodiment of the roof section shown in FIGS. 5 and 6.
Figure 6:
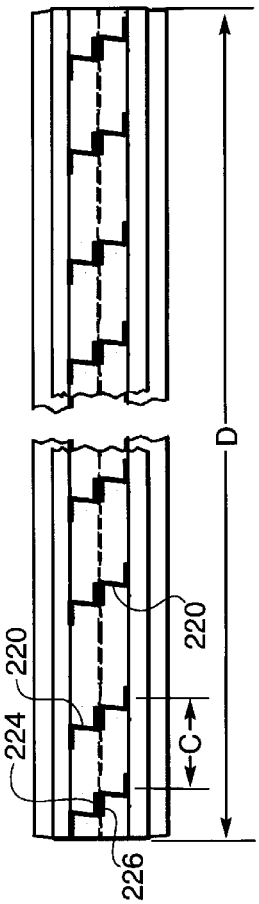
FIG. 6 is a top view of a section of the ridge vent assembly of FIG. 5.
Figure 5:
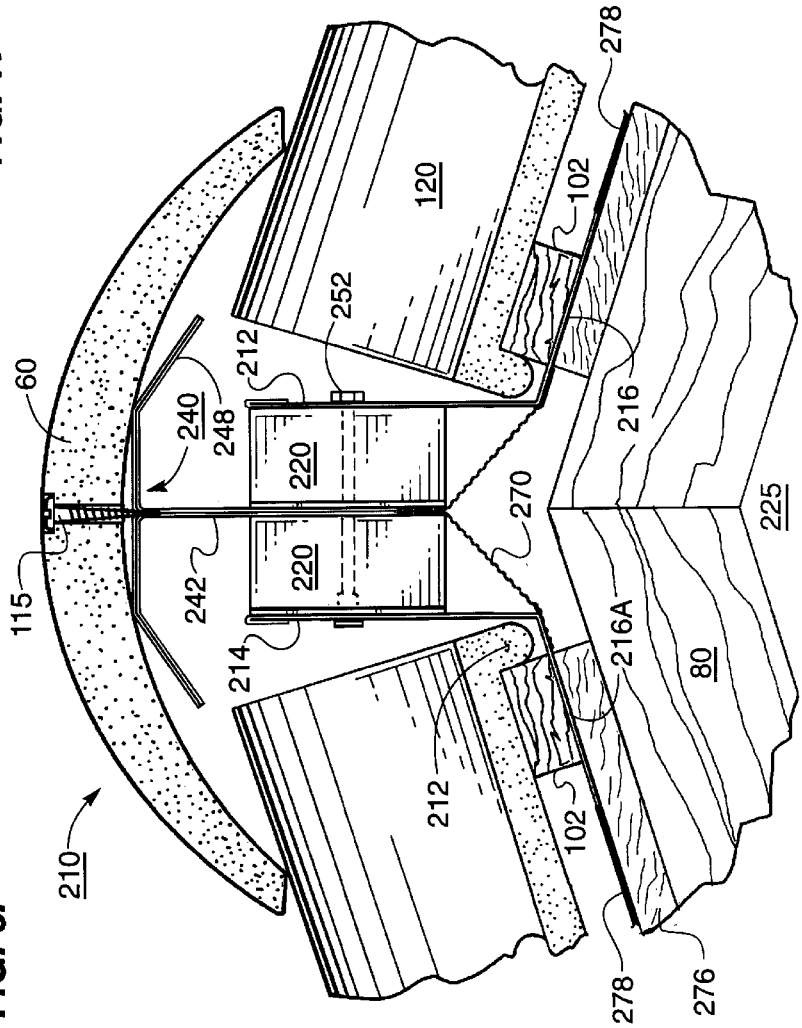
FIG. 5 is an end view of the ridge showing an alternate embodiment of the ridge vent assembly of the present invention installed.

An alternate embodiment of the invention is shown in FIGS. 5, 6 and 7. In this embodiment, the roof vent assembly is designated by the numeral 210 and is generally fabricated as described above including side walls 212, 214 having flashing sections 216, 216A at their lower end which are received on the roof sheeting 276 over the paper 278. A screen 270 extends between the side walls and extends beneath the flashing sections 216, 216A. The screen is shown as having angular sections which diverge outwardly from support 240. Support 240 is comprised of a central web 242 and upper T-section 248 which supports the roof cap 60.

In the embodiment of the invention shown in FIGS. 5 through 7, the sides 212 and 214 are maintained in spaced-apart relationship by Z-shaped spacers 220 as best seen in FIGS. 6 and 7. Each of the Z-shaped spacers have central web 222 and oppositely extending flanges 224 and 226. The Z-shaped spacers are positioned in offsetting relationship as best seen in FIG. 6 with the flange 224 of one spacer abutting the flange 226 of the adjacent spacer. Again, the spacers provide minimum obstruction to air flow from space 225 and allow the support 240 to be vertically positioned as required by the roofing contractor. The spacers, side walls and support are again secured by a suitable fastener 252 which may be a screw or a bolt. The cap 60 is secured to the support 240 by fastener 115. The tile 220 are supported on battens 216. The upper tier of tiles may have a lip 212 which overlaps the battens. In both of the embodiments of FIGS. 1 to 3 and 4 to 6, the tiles 120 and cap 60 can be replaced with other roofing components such as metal or material other than ceramic or concrete.

It will be obvious to those skilled in the art to make various changes, alterations and modifications to the invention described herein. To the extent such changes, alterations and modifications do not depart from the spirit and scope of the appended claims. They are intended to be encompassed therein.

I claim:

1. A venting assembly mountable along the ridge of a roof having rafters that form a peak having a ridge opening in the roof, said venting assembly comprising:

(a) spaced-apart side members securable to the roof at flashing sections at opposite sides of said ridge;

(b) spacer members interposed between said side members;

(c) a support having a web and a flange at the upper end forming a general T-shaped section, said web insertable between said spacer members to position said flange at a predetermined elevation above the ridge line; and (d) fastener members extending through at least one of said side members and said spacer members and into said support.

2. The venting assembly of claim 1 wherein said spacer members comprise tubing sections.

3. The venting assembly of claim 1 wherein said spacer members comprise Z-shaped sections.

4. The venting assembly of claim 1 wherein said support flanges extend oppositely from said web and define a generally longitudinally extending indentation therebetween.

5. The venting assembly of claim 1 wherein said support has a web comprised of adjacent sections of sheet metal whereby a fastener may be engaged between said sections of sheet metal.

6. The venting assembly of claim 1 wherein said venting assemblies are provided in prefabricated sections of predetermined length which sections may be abutted end-to-end.

7. A roof vent assembly mountable along the ridge of a roof having rafters that form a peak having a ridge opening, said venting assembly comprising:

(a) spaced-apart side members securable at flashing sections to the roof to extend along said ridge opening;

(b) spacer members interposed between said side members, said spacers defining a generally vertical space therebetween;

(c) a support having a web and a flange forming a general T-shape, said web inserted in said vertical space between spacers;

(d) fastener extending laterally through said side members, spacers and web to support the support of a predetermined elevation; and (e) a cap secured to said flange above said ridge opening by fasteners extending into said support.

8. The roof vent assembly of claim 7 wherein said cap is sheet metal.

9. The roof vent assembly of claim 7 wherein said cap is tile.

10. The roof vent assembly of claim 7 further including a screen extending between said side members across the ridge opening.

* * * * *